United States Patent [19]

Lillibridge et al.

[11] 3,976,303

[45] Aug. 24, 1976

[54] BOOT SCRAPER FOR SKIIS

[76] Inventors: Christopher B. Lillibridge, 29 Ridgewood Drive, Norwich, Conn. 06360; Alfred H. Lotring, R.D. No. 1, Lord's Point, Stonington, Conn. 06378

[22] Filed: June 6, 1975

[21] Appl. No.: 584,591

[52] U.S. Cl. ..... 280/11.37 E; 15/237

[51] Int. Cl.[2] ..... A63C 11/00; A63C 11/18

[58] Field of Search ..... 280/11.13 T, 11.37 E, 280/11.37 R, 11.37 T; 15/237, 238, 239, 240, 241, 215

[56] References Cited

UNITED STATES PATENTS

| | | | |
|---|---|---|---|
| 771,809 | 10/1904 | Burnell | 15/215 |
| 3,284,091 | 11/1966 | Spier | 280/11.13 T |
| 3,295,860 | 1/1967 | Von Hoven | 280/11.13 T |
| 3,826,518 | 7/1974 | Hennig | 280/11.13 T |
| D33,485 | 10/1900 | Taft | 15/237 |

FOREIGN PATENTS OR APPLICATIONS

| | | | |
|---|---|---|---|
| 60,822 | 8/1913 | Austria | 280/11.13 T |

*Primary Examiner*—M. H. Wood, Jr.
*Assistant Examiner*—David M. Mitchell

[57] ABSTRACT

A device adapted to be mounted on, or integral with the upper surface of a snow ski for the purpose of removing ice, snow, mud, and the like from the bottom of a skier's boot prior to insertion of the boot into the binding. The device may be in the shape of a disk or may have any one of a variety of other outer contours presenting a scraping surface of substantially uniform magnitude to a ski boot as the boot is drawn toward and across a central region of the device regardless of the orientation of the ski relative to the boot.

13 Claims, 13 Drawing Figures

BOOT SCRAPER FOR SKIIS

BACKGROUND OF THE INVENTION

1. Field of Invention

This invention relates generally to snow skis and, more particularly, to improved boot scrapers for use with snow skis.

2. Description of the Prior Art

In recent years, snow skiing has become one of the world's fastest growing sports. Each winter, increasing numbers of enthusiasts are drawn to the ski slopes. In keeping with their enthusiasm, amateurs and experts alike are continuously seeking newer and improved equipment to further improve their skills and extend their performance and enjoyment.

One difficulty plaguing skiers concerns the condition of the bottom or under surface of a skier's boot. It is essential that the under surface of the boot be clean and free of foreign material such as snow, ice, mud, and the like prior to insertion of the boot into the binding of the ski. Unless the under surface of the boot is clean, the skier will not be positioned firmly on the upper surface of the ski. Furthermore, the boot might otherwise, undesirably, become fixed to the ski by freezing of the snow between the boot and ski or by reason of the adhering quality of the mud. However, with a clean under surface, the boot can be readily and properly seated within the ski binding and, in this condition, the boot can be easily locked to and unlocked from the ski and, more importantly, can be readily released from the binding under emergency conditions.

Until recently, a skier was forced to rely on hand-held scraping devices or whatever natural scraping surface might be available as he or she was preparing to ski. More recently, however, the art has developed to the point at which scrapers have been actually mounted on the upper surface of the ski so that they would be readily available to a skier. However, the known constructions could present a number of serious drawbacks that are overcome by the present invention. At this point it is important to explain, and it should be stressed, that for purposes of both safety and performance, a ski should be permitted to flex about axes generally perpendicular to its longitudinal axis. The primary drawback of earlier designs resided in the large size either of the surface area contacting the ski or of the length of the device in contact with the ski. By reason of their large size or length, these known devices could seriously reduce the capability of the ski to flex in the proper manner with a resultant reduction of both safety and performance.

An additional drawback of the known scrapers resided in the fact that they provided only limited scraping angles to the ski boot relative to the ski; that is, unless the ski was properly oriented relative to the ski boot, the scraper was of minimum value in achieving its intended purpose. Furthermore, even a design that offered a somewhat improved effectiveness with respect to relative orientation of the boot and ski could become rapidly clogged with ice, snow, mud, and the like, rendering it useless until it was itself cleaned by the skier. Additionally, some scrapers had sharp edges that could permit crossed skis to become interlocked or could result in injury to a skier who accidentally fell on the scraper.

3. Summary of the Invention

It was with these various drawbacks in mind that the present invention was conceived. The invention, then, relates generally to a device adapted to be mounted on the upper surface of a snow ski for the purpose of removing ice, snow, mud, and the like from the bottom of a skier's boot prior to insertion of the boot ito the binding. The device is generally of low profile and in the shape of a disk, a ring, or variations of those shapes, and may be mounted on a ski by means of mechanical fasteners, or by means of a suitable adhesive. New skis may be sold already incorporating the scraper, although the scraper being disclosed can also be readily mounted on old or conventional skis or may be formed integrally with the ski.

As conceived, the invention provides a compact scraper having an outer contour formed such that the magnitude of a horizontal projection of the scraping surface presented to a ski boot as the boot is advanced toward and across a central region of an upper surface of the scraper is substantially uniform without regard to the orientation of the ski relative to the boot.

Also, the invention provides a scraper offering a maximum scraping surface while having a minimum surface in contact with the ski. Such a design assures a minimal effect on the flexibility of the ski with which it is being used.

Another feature of the invention is that it is usable regardless of the orientation of the ski.

Still another feature of the invention is its continuous availability for use, being permanently fixed to a ski.

Further features of the invention are its compactness, low cost, and ability to be fabricated from a variety of materials.

Still a further feature of the invention is its resistance to accumulation of the material being scraped from the bottom of a boot.

Yet a further feature of the invention is its design which prevents crossed skis from becoming interlocked.

Other and further features of the invention will become apparent from the following description taken in conjunction with the following drawings. It is to be understood that both the foregoing general description and the following detailed description are exemplary and explanatory but are not restrictive of the invention. The accompanying drawings, which are incorporated in and constitute a part of this invention, illustrate different embodiments of the invention and together with the description, serve to explain the principles of the invention.

DESCRIPTION OF THE PREFERRED EMBODIMENTS

Figure 1:
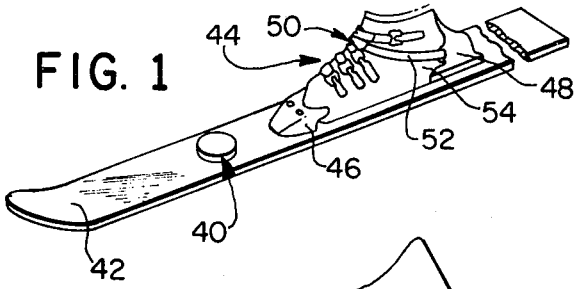
FIG. 1 is a perspective view of a snow ski utilizing the invention and illustrating the invention positioned at a location forward of the boot binding.
Figure 2:
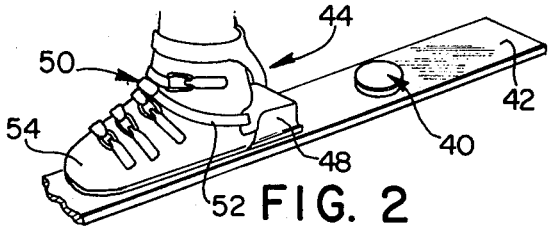
FIG. 2 is a perspective view of a portion of a snow ski utilizing the invention as illustrated in FIG. 1 but illustrating the invention positioned at a location aft of the boot binding.

Refer now to the drawings and initially to FIGS. 1 and 2 which generally illustrate the invention as it is applied to a snow ski. In FIG. 1, a scraper 40 in the form of a disk is shown mounted on an upper surface of a snow ski 42 forward of a boot binding 44. The scraper 40 is preferably of a low profile so as to prevent crossed skis from becoming interlocked between it and the boot binding. The boot binding 44 includes a toe receiving element 46, a heel receiving element 48 and straps 50 and 52 secured to the element 48 for extension around a ski boot 54. It will be appreciated that the description of the boot binding 44 is merely illustrative of a well known construction and forms no part of the present invention.

Referring to FIG. 2, an arrangement is shown similar to that in FIG. 1 except that, in this view, scraper 40 is mounted on the snow ski 42 at a location aft of the boot binding 44. It should be appreciated, then, that the scraper 40 may be mounted on the snow ski 42 at any reasonable location suitable to the user. One skier may prefer that the scraper 40 be located forward of the binding 44, while another skier may prefer that it be positioned aft of the binding. FIGS. 1 and 2 merely illustrate, respectively, each of these preferences.

Figure 3:
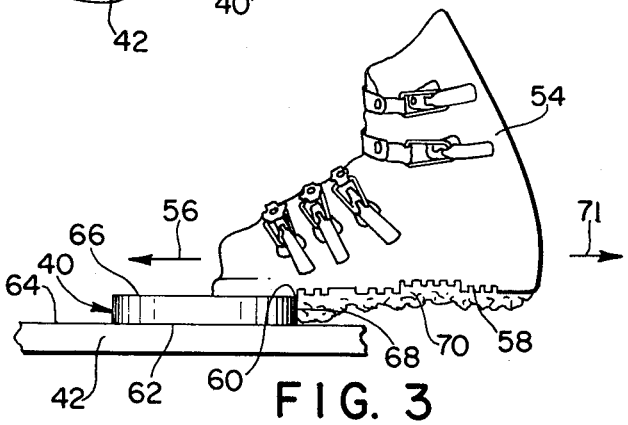
FIG. 3 is a detail side elevation view of the invention illustrated in FIGS. 1 and 2 and descriptive of its intended use.

In FIG. 3, the ski boot 54 is shown being pushed in the direction of an arrow 56 such that an under surface 58 of the boot engages a scraping edge 60 of the scraper 40. The scraper 40 includes a lower surface 62 conformable to an upper surface 64 of the ski 42. The scraper 40 further includes an upper surface 66 which is substantially planar horizontally and across which the under surface 58 of the boot 54 can slide. Located between the surfaces 62 and 66 of the scraper 40 is a scraping surface 68. The scraping edge 60 is formed at the intersection of the scraping surface 68 and the upper surface 66. Although the scraping surface 68 is illustrated as being generally perpendicular to the surfaces 62 and 66, it is within the scope of the invention for the surface 68 to be beveled in any desired fashion with respect to the surfaces 62 and 66. In addition, although the surfaces 62 and 66 are illustrated as being generally parallel to one another, it will be understood that the surface 66 may be inclined in some desirable fashion relative to the surface 62.

As the ski boot 54 is pushed or drawn across the scraper 40, material 70 such as snow, ice, mud, and the like, which adheres to the under surface 58 of the boot engages the scraping surface 68. The scraping edge 60 first engages the material 70 and as the material is removed from the under surface 58, it is caused to slide along the scraping surface 68. Upon further advancement of the boot 54 across the scraper 40, the material 70 drops off the under surface 58 and onto the upper surface 64 of the ski 42. Because the shape of the scraper 40 is substantially circular, the scraping edge 60 permits scraping of the boot 54 regardless of the orientation of the ski 42 relative to the skier. In a similar fashion, the boot 52 may be drawn in the direction of an arrow 71, but in all other respects, the operation just described would be applicable in this instance as well.

Figure 4:
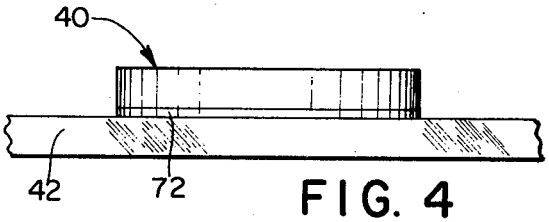
FIG. 4 is a detail side elevation view of the invention illustrating one manner of mounting it on a ski.

With reference to FIG. 4, the scraper 40 is shown mounted on a ski 42 by means of an adhesive 72. The adhesive 72 may be any suitable glue or expoxy or it may be two sided tape which has the prerequisite strength and is commercially available.

Figure 5:
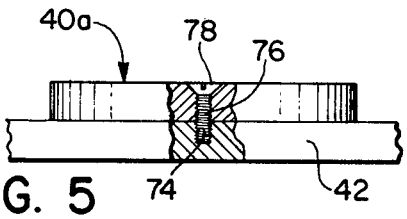
FIG. 5 is a detail side elevation view of the invention illustrating another manner of mounting it on a ski.

FIG. 5 is illustrative of a mounting for the scraper that differs somewhat from that shown in FIG. 4. In this instance, a scraper **40*a* is slightly modified to include a bore 74 adapted to receive a screw 76 or other suitable mechanical fastener device, the extremety of which is threadedly engaged with the ski 42. Although one screw 76 is shown for this purpose, it will be understood that two or more screws may be provided for added strength, if desired. As shown in FIG. 5, it is preferred that a head 78 of the screw 76 be recessed so as not to interfere with the under surface 58 of the boot 54**.

Figure 6:
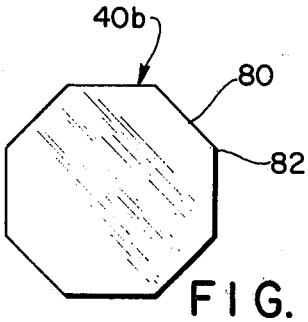
FIGS. 6, 7, 8, 9, 10, 11, and 12 are top plan views, respectively, of various shapes which the invention may assume.

FIG. 6 represents a modification of the configuration of the scraper shown in FIGS. 1 through 5. In this instance, a scraper **40*b* is in the shape of an octagon, that is, the outer limits of the upper surface of the scraper 40*b* at its scraping edge define an octagon. The octagonal shape is merely representative of a large number of polygonal shapes which have three or more sides or scraping surfaces, each of the sides being preferably equilateral. The scraper 40*b* is illustrated having sides 80 and apices 82**, alternately and successively.

Figure 7:
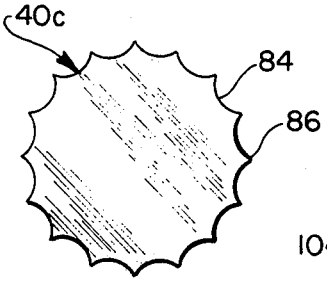

FIG. 7 illustrates a scraper **40*c* having a shape modified from that of the scraper 40*b*. Specifically, in place of the straight or flat sides or scraping surfaces 80, the scraper 40*c* is provided with concave scraping surfaces 84 alternating successively with apices 86**.

Figure 8:
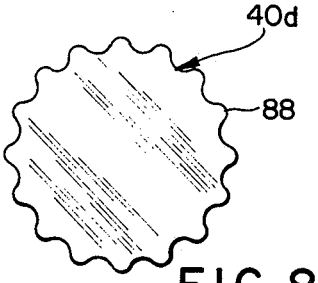

A scraper **40*d* is illustrated in FIG. 8 which is a further modification of the scrapers 40*b* and 40*c*, having an outer contour or scraping surface 88** which may be akin to the shape of a closed sine wave.

Figure 9:
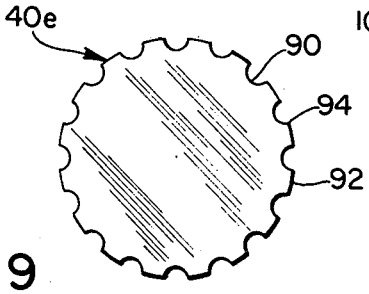

In FIG. 9 a scraper **40*e* is illustrated having a shape modified from that of the scraper 40*c*. Specifically, scraper 40*e* is provided with concave surfaces 90 similar to the surfaces 84. However, in place of the edges or apices 86 of the scraper 40*c*, the scraper 40*e* is provided with convex surfaces 92. Each of the concave surfaces 90 meets each of the convex surfaces 92 at an apex 94. Thus, it can be said that the scraper 40*e*** has an upper surface whose outer limits at the scraping edge define a continuous enclosed alternating successive series of concave curves, apices, and convex curves.

Figure 10:
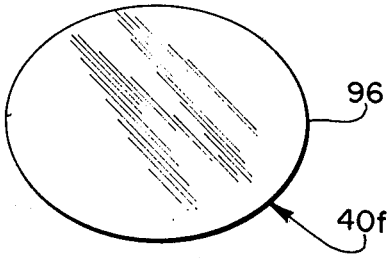

FIG. 10 illustrates a scraper **40*f* having still another modified shape. In this instance, it can be said that the outer limits of an upper surface of the scraper 40*f*** define an ellipse.

Figure 11:
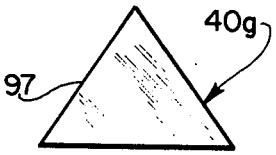

FIG. 11 illustrates a scraper **40*g* having yet a further modified shape. As shown, the outer limits of an upper surface of the scraper 40*g*** define an equilateral triangle.

Figure 13:
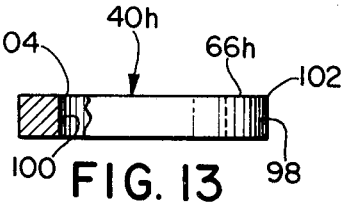
FIG. 13 is a side elevation view, partially cut away and in section of the device illustrated in FIG. 12.
Figure 12:
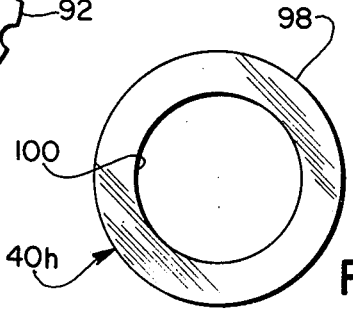

FIGS. 12 and 13 illustrate a scraper **40*h* having yet a further modified shape. As illustrated, the scraper 40*h* is a substantially horizontally disposed ring having an outer scraping surface 98 and a similar inner scraping surface 100. An outer scraping edge 102 is defined by the intersection of the surface 98 and an upper surface 66*h* of the scraper 40*h*. Similarly, an inner scraping edge 104 is defined by the intersection of the surface 100 and the upper surface 66*h* of the scraper 40*h*. Thus, it will be appreciated that in use, the scraper 40*h* can simultaneously present both scraping edges 102** and 104 to the under surface 58 of the boot 52 for even more rapid and effective cleaning of the boot.

The general concept of the invention is to provide a compact scraper having an outer contour conformed such that the magnitude of a horizontal projection of the scraping surface presented to a ski boot as the boot is advanced toward and across a central region of the upper surface 66 while engaging the scraping edge 60 is substantially uniform regardless of the direction in azimuth from which the boot approaches the scraper. Such uniformity may be achieved if the projected scraping surface presented to the boot is a maximum for that particular scraper as the boot approaches the scraper from at least six different directions. For example, such uniformity is achieved by a scraper contoured as an equilateral triangle (FIG. 11) for the reason that such a scraper presents a maximum projected scraping surface to a boot when the boot approaches from any one of six different directions. Such uniformity is similarly achieved by a scraper contoured as an octagon (FIG. 6) for the reason that such a scraper presents a maximum projected scraping surface to a boot when the boot approaches from any one of eight different directions. At the same time, it will be appreciated, that even when the boot approaches the scraper having such outer contours from directions other than those presenting a maximum scraping surface to the boot, such reduced projections of the scraping surface in any event are only slightly smaller than the maximum and are considered to be uniform regardless of the angle of approach of the boot. Of course, it will be appreciated that a contour in the shape of a circle is the ultimate in that the projected scraping surface of such a scraper is maximum regardless of the approach angle of the boot. Although not necessary to achieve this result, it is preferred that each succeeding side, or series of sides, or curve, or series of curves, as the case may be, be of a similar dimension to its preceding side, or series of sides, or curve, or series of curves. Examples of other possible shapes and contours are virtually unlimited in addition to those illustrated in the drawings.

The invention thus disclosed provides a device adapted to be mounted on the upper surface of a snow ski for the stated purpose of removing ice, snow, mud, and other material from the bottom of a skier's boot. As disclosed, the invention presents a maximum scraping surface to a boot while requiring a minimum contacting surface with the ski. The design also prevents a substantial degree of build-up or accumulation of material on itself, permits a boot to be scraped without regard to the particular orientation of the ski, and allows a ski to flex to a substantial extent about axes transverse to the longitudinal axis of the ski.

The invention in its broader aspects is not limited to the specific details shown and described; departures may be made from such details without departing from the principles of the invention and without sacrificing its chief advantages.

What is claimed is:

1. Apparatus usable with a snow ski for removing material from the bottom of a ski boot comprising:

a body adapted to be mounted on the upper surface of a ski;

said body having a lower surface conformable to the upper surface of the ski, an upper surface substantially planar horizontally spaced from said lower surface, and a scraping surface interposed between said lower and upper surfaces, said scraping surface intersecting said upper surface at a scraping edge, said scraping surface and said scraping edge being conformed such that the magnitude of a horizontal projection of said scraping surface presented to a ski boot as the boot is moved toward and across a central region of said upper surface while engaging said scraping edge is substantially uniform regardless of the direction of movement in azimuth of the boot relative to said body.

2. Apparatus as set forth in claim 1 including means for mounting said body onto the upper surface of the ski.

3. Apparatus as set forth in claim 2 wherein said mounting means includes a mechanical fastener device connecting said body to the ski.

4. Apparatus as set forth in claim 2 wherein said mounting means includes adhesive for attaching said lower surface to the upper surface of the ski.

5. Apparatus as set forth in claim 1 wherein said body is a disk.

6. Apparatus as set forth in claim 1 wherein the outer limits of said upper surface at said scraping edge define a regular polygon.

7. Apparatus as set forth in claim 1 wherein the outer limits of said upper surface at said scraping edge define a continuous and closed alternating series of concave curves and apices.

8. Apparatus as set forth in claim 1 wherein the outer limits of said upper surface at said scraping edge define a continuous and closed sine curve.

9. Apparatus as set forth in claim 1 wherein the outer limits of said upper surface at said scraping edge define a continuous and closed alternating series of concave curves, apices, and convex curves.

10. Apparatus as set forth in claim 1 wherein the outer limits of said upper surface at said scraping edge define an ellipse.

11. Apparatus as set forth in claim 1 wherein the outer limits of said upper surface at said scraping edge define an equilateral triangle.

12. Apparatus as set forth in claim 1 wherein said body is a substantially horizontally disposed ring, said lower and upper surfaces being substantially flat, said ring having an inner scraping surface spaced from said scraping surface and interposed between said lower and upper surfaces, said inner scraping surface intersecting said upper surface at an inner scraping edge such that said scraping edge and said inner scraping edge can engage the boot simultaneously as it is moved toward and across the central region of said upper surface.

13. Apparatus for removing material from the bottom of a ski boot comprising:

a snow ski;

a body integral with the upper surface of said snow ski;

said body having a sliding surface substantially planar horizontally spaced from the upper surface of said snow ski, and a scraping surface interposed between said sliding surface and the upper surface of said snow ski, said scraping surface intersecting said sliding surface at a scraping edge, said scraping surface and said scraping edge being conformed such that the magnitude of a horizontal projection of said scraping surface presented to a ski boot as the boot is drawn toward and across a central region of said sliding surface while engaging said scraping edge is substantially uniform regardless of the direction of movement in azimuth of the boot relative to said body.

* * * * *